US010494124B2

(12) United States Patent
Ballarotti et al.

(10) Patent No.: US 10,494,124 B2
(45) Date of Patent: Dec. 3, 2019

(54) DEVICE FOR APPLYING AROUND GROUPS OF TWO OR MORE CONTAINERS A TAPE PROVIDED ON ONE SURFACE WITH ADHESIVE WITHOUT DISCONTINUITIES

(71) Applicant: P.E. LABELLERS S.P.A., Porto Mantovano (IT)

(72) Inventors: Mario Ballarotti, Marmirolo (IT); Nicola Schinelli, Curtatone (IT)

(73) Assignee: P.E. LABELLERS S.P.A., Porto Mantovano (IT)

( * ) Notice: Subject to any disclaimer, the term of this patent is extended or adjusted under 35 U.S.C. 154(b) by 474 days.

(21) Appl. No.: 14/909,806

(22) PCT Filed: Apr. 10, 2014

(86) PCT No.: PCT/EP2014/057246
§ 371 (c)(1),
(2) Date: Feb. 3, 2016

(87) PCT Pub. No.: WO2015/018538
PCT Pub. Date: Feb. 12, 2015

(65) Prior Publication Data

US 2016/0167816 A1 Jun. 16, 2016

(30) Foreign Application Priority Data

Aug. 8, 2013 (IT) ..... VR2013A0193

(51) Int. Cl.
*B65B 27/04* (2006.01)
*B65B 21/24* (2006.01)
(Continued)

(52) U.S. Cl.
CPC ..... *B65B 27/04* (2013.01); *B65B 13/187* (2013.01); *B65B 13/22* (2013.01); *B65B 21/245* (2013.01);
(Continued)

(58) Field of Classification Search
CPC ..... B65B 27/04; B65B 21/245; B65B 35/46; B65B 41/16; B65B 13/187; B65B 13/22; B65H 23/185; B65H 23/192
See application file for complete search history.

(56) References Cited

U.S. PATENT DOCUMENTS 3,344,740 A * 10/1967 Hilton ..... B65B 51/08 101/228
4,795,956 A * 1/1989 Beck ..... B21D 43/021 198/805

(Continued)

FOREIGN PATENT DOCUMENTS

CN 102198868 9/2011
CN 102482011 5/2012

(Continued)

OTHER PUBLICATIONS

International Search Report (Form PCT/ISA/210) for International Application No. PCT/EP2014/057246 dated May 23, 2014.
Italian Search Report for IT VR20130193 dated Nov. 14, 2013.

*Primary Examiner* — Michelle Lopez
*Assistant Examiner* — Chinyere J Rushing-Tucker
(74) *Attorney, Agent, or Firm* — Thompson Hine LLP

(57) ABSTRACT

A device for applying, around groups of two or more containers, a tape provided on one surface with adhesive without discontinuities, which comprises a carousel provided with plates shaped so that each one accommodates a group of containers to be wrapped together with the tape, a drum for cutting and transferring portions of tape of a length necessary to wrap each group, a roller for unwinding the tape for feeding the drum, a roller for preliminary unwinding of the tape from a reel, adapted to feed the unwinding roller with the interposition of a compensation buffer and a device
(Continued)

for compensating the tension of the tape between the reel and the preliminary unwinding roller.

9 Claims, 4 Drawing Sheets

(51) Int. Cl.

| | |
|---|---|
| ***B65B 35/46*** | (2006.01) |
| ***B65H 23/185*** | (2006.01) |
| ***B65H 23/192*** | (2006.01) |
| ***B65B 13/18*** | (2006.01) |
| ***B65B 13/22*** | (2006.01) |
| ***B65B 41/16*** | (2006.01) |

(52) U.S. Cl.
CPC ..... *B65B 35/46* (2013.01); *B65B 41/16* (2013.01); *B65H 23/185* (2013.01); *B65H 23/192* (2013.01); *B65H 2404/143* (2013.01); *B65H 2408/21* (2013.01); *B65H 2553/41* (2013.01); *B65H 2701/11332* (2013.01); *B65H 2701/1722* (2013.01); *B65H 2801/81* (2013.01)

(56) References Cited

U.S. PATENT DOCUMENTS 4,798,956 A * 1/1989 Hochstein ..... B60S 1/0822 15/DIG. 15
5,657,941 A * 8/1997 Simons ..... B65H 23/1825 242/420.6
2009/0032194 A1* 2/2009 Schinelli ..... B65C 9/1807 156/355
2010/0018650 A1* 1/2010 Ballarotti ..... B65C 9/1819 156/446
2010/0058716 A1* 3/2010 Leykamm ..... B65B 21/245 53/446
2010/0096091 A1* 4/2010 Ballarotti ..... B65C 9/1819 156/521
2010/0252201 A1* 10/2010 Ballarotti ..... B65C 9/1819 156/361
2015/0175374 A1* 6/2015 Horaguchi ..... B65H 23/185 226/1
2015/0251465 A1* 9/2015 Hori ..... B65H 18/08 347/16
2015/0328909 A1* 11/2015 Takizawa ..... B41J 13/0009 347/104

FOREIGN PATENT DOCUMENTS

| | | | |
|---|---|---|---|
| CN | 102556391 | | 7/2012 |
| DE | 10 2011 015343 | A1 | 4/2012 |
| EP | 0 844 192 | A1 | 5/1998 |
| JP | S55-056408 | A | 4/1980 |
| JP | 2004-161485 | A | 6/2004 |
| JP | 2009-274810 | A | 11/2009 |
| WO | WO 94/27869 | A1 | 8/1994 |
| WO | WO 2012/152501 | A1 | 11/2012 |

* cited by examiner

DEVICE FOR APPLYING AROUND GROUPS OF TWO OR MORE CONTAINERS A TAPE PROVIDED ON ONE SURFACE WITH ADHESIVE WITHOUT DISCONTINUITIES

The present invention relates to a device for applying, around groups of two or more containers, a tape provided on one surface with adhesive without discontinuities.

It is known that the market often requires a type of packaging of containers, especially of beverages, that provides the formation of groups formed by two or more of said containers.

A classic method for the formation of such groups consists in applying, around the containers intended to form each group, a tape that is provided with a film of adhesive without discontinuities at the surface directed toward said containers. In this manner, fixed groups of containers are joined to each other and made available to users.

Currently known devices for providing the method described above are unable to offer the high productivities currently required, and therefore the aim of the present invention is to provide a device for applying a tape around groups of containers that is capable of operating with high productivity.

This aim is achieved by a device for applying, around groups of two or more containers, a tape provided on one surface with adhesive without discontinuities, according to the invention, characterized in that it comprises the characteristics described in the appended claims.

Further characteristics and advantages of the present invention will become better apparent from the description of a preferred but not exclusive embodiment of the invention, illustrated by way of non-limiting example in the accompanying drawings, wherein.

With reference to the figures, the numeral 1 designates a rotating carousel provided with a plurality of plates for supporting the containers, of which only the ones designated by 2, 3 and 4 are shown.

Such plates are shaped so that each one accommodates a group of containers to be wrapped together by means of a tape 5, drawn from a reel 6, which is mounted on a roller 6*a* that is motorized by the motor 6*b*; it is important to note that said tape 5 has, on the surface in contact with the reel 6, a layer of adhesive that has no discontinuities, i.e., is applied to the surface without any interruption.

Figure 1:
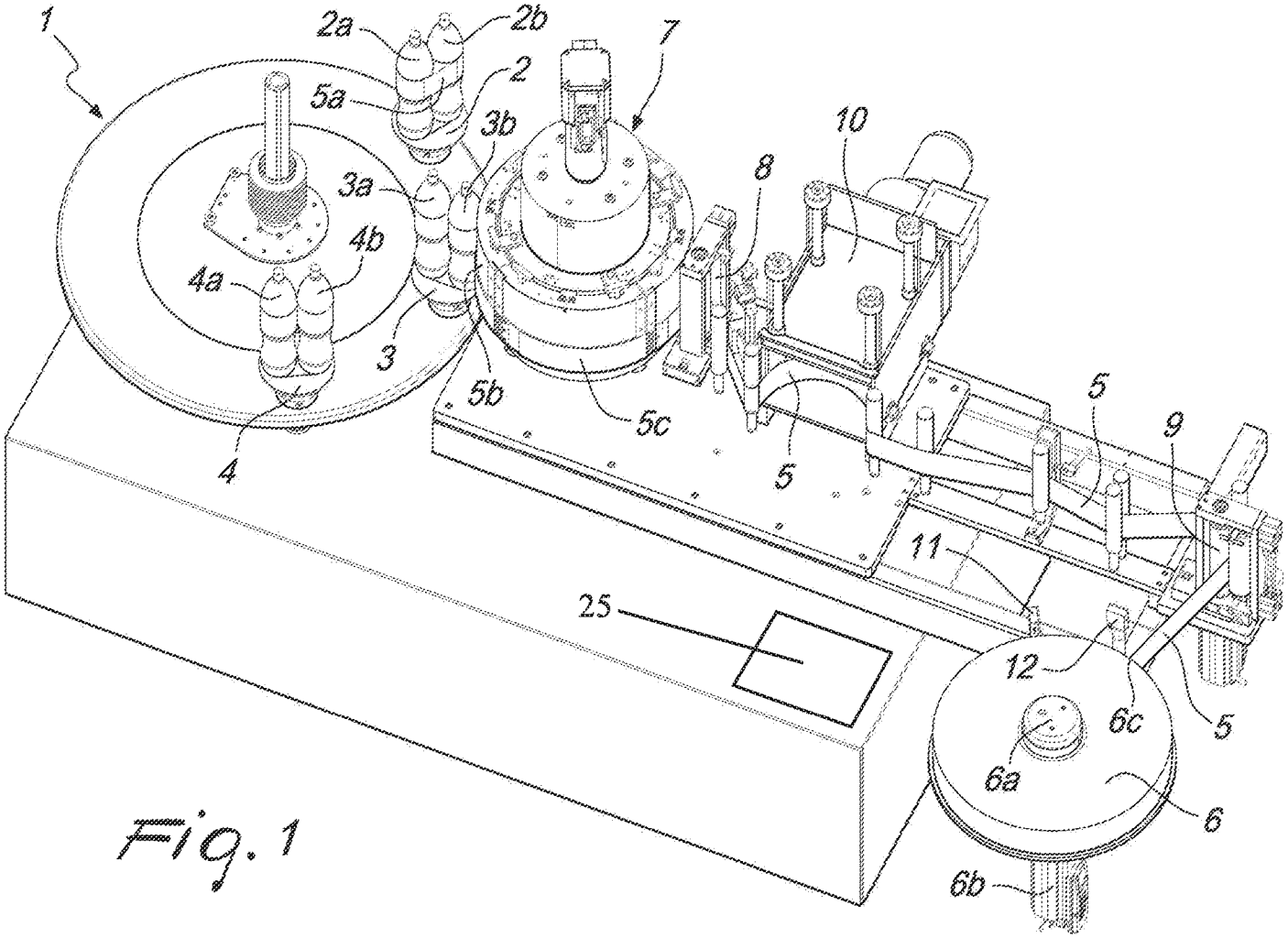
FIG. 1 is a perspective view of the device according to the invention.

Thus, FIG. 1 shows for example the two containers 2*a*, 2*b* rested on the plate 2 and already wrapped and joined by means of a portion of tape 5*a*, the two containers 3*a*, 3*b* rested on the plate 3 and intended to be wrapped and joined by a portion of tape 5*b*, shown still adhering to a per se known cutting and transfer drum 7, and finally the containers 4*a*, 4*b*, which rest on the plate 4 and will be wrapped by a portion of tape 5*c*, also shown still adhering to the cutting and transfer drum 7.

In a known manner, the cutting and transfer drum 7 is fed with tape 5 by means of an unwinding roller 8, which in turn receives such tape 5 from a preliminary unwinding roller 9, and between the two rollers 8, 9 there is a compensation buffer 10, of a known type, which acts in the sense of maintaining the correct tension of the tape 5 when the speed of the two rollers is not synchronized perfectly.

The preliminary unwinding roller 9 separates the tape 5 from the reel 6, which is mounted on the roller 6*a* moved by the motor 6*b* with an angular velocity that varies as a function of the diameter of said reel under known control on the part of a photocell 11, and for this purpose it has enough power to overcome the separation force, which is subject to unpredictable variables, such as most of all those that arise from the state, type and thickness of the film of adhesive that is present on the tape 5.

In order to deal with the unpredictable changes caused by the variables without affecting the operation of the machine, there is therefore, comprised within the control unit 25 of the machine, a compensation device between the preliminary unwinding roller 9 and the roller 6*a* of the reel 6, which intervenes when the speed of said rollers is not synchronized perfectly to maintain the tension of the tape 5 at a correct value.

For this purpose, the compensation device is provided with means for detecting the position of the portion of tape comprised between the section 6*c* for separation from the reel 6 and the preliminary unwinding roller 9, and such means comprise the photocell 12.

Figure 2:
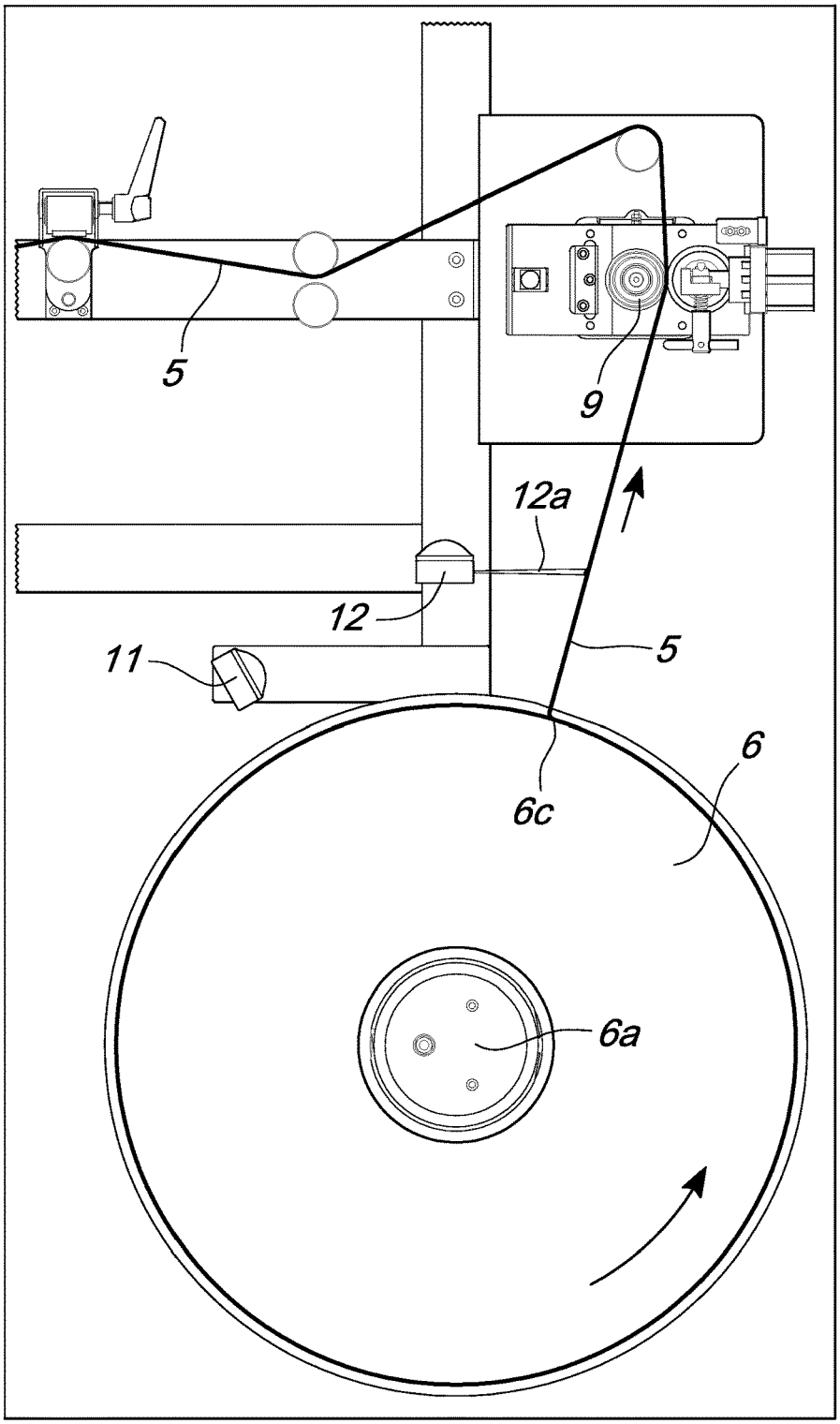
FIGS. 2, 3 and 4 are views of three different operating modes of the device of the present invention.

If the reel 6 and the roller 9 have the same peripheral speed, the position of the controlled portion of the tape is the one shown, designated indeed by the reference numeral 5, in FIGS. 1 and 2, and the beam of the photocell is materialized by the line 12*a*; in this case, the compensation device leaves things as they are.

Figure 3:
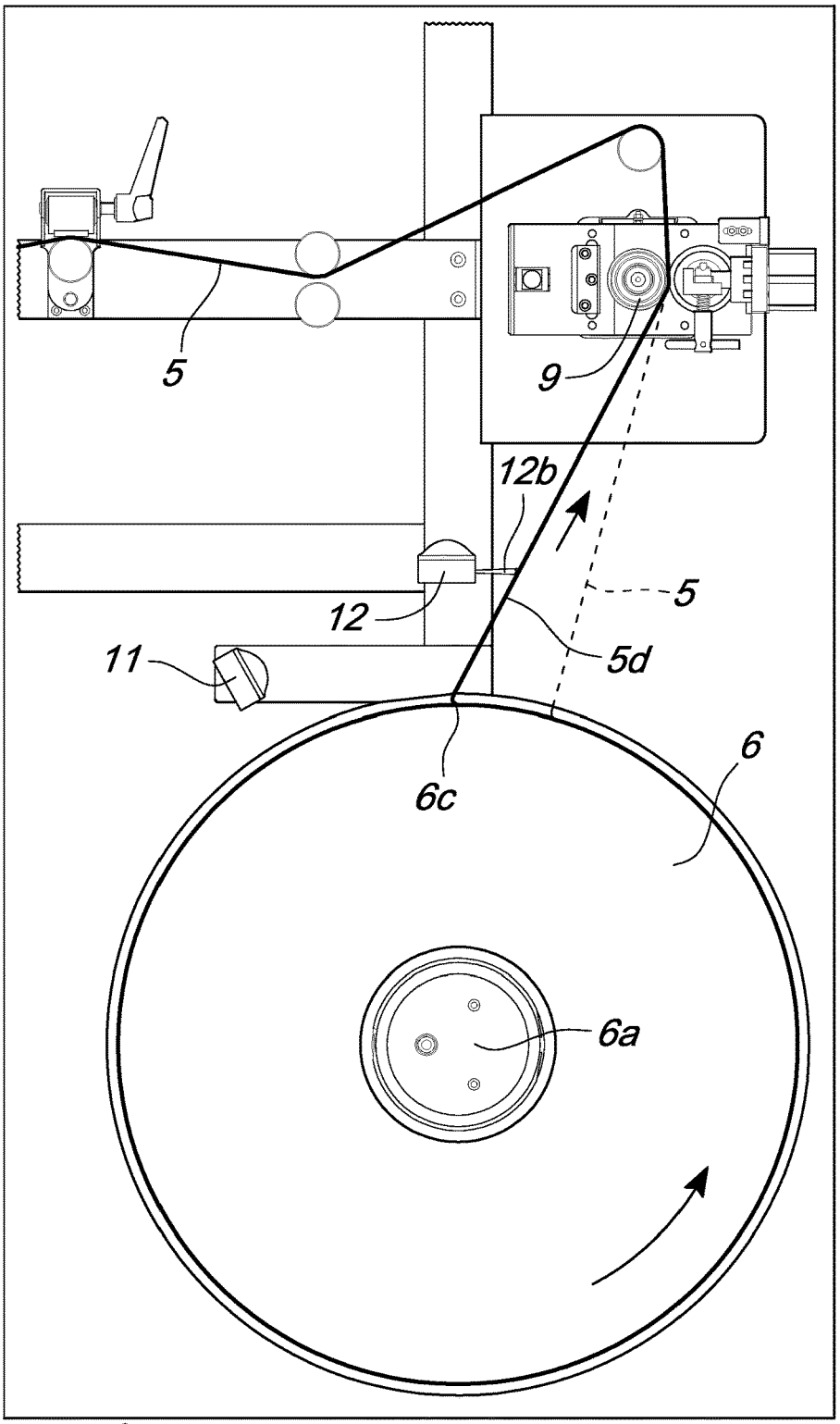
Figure 4:
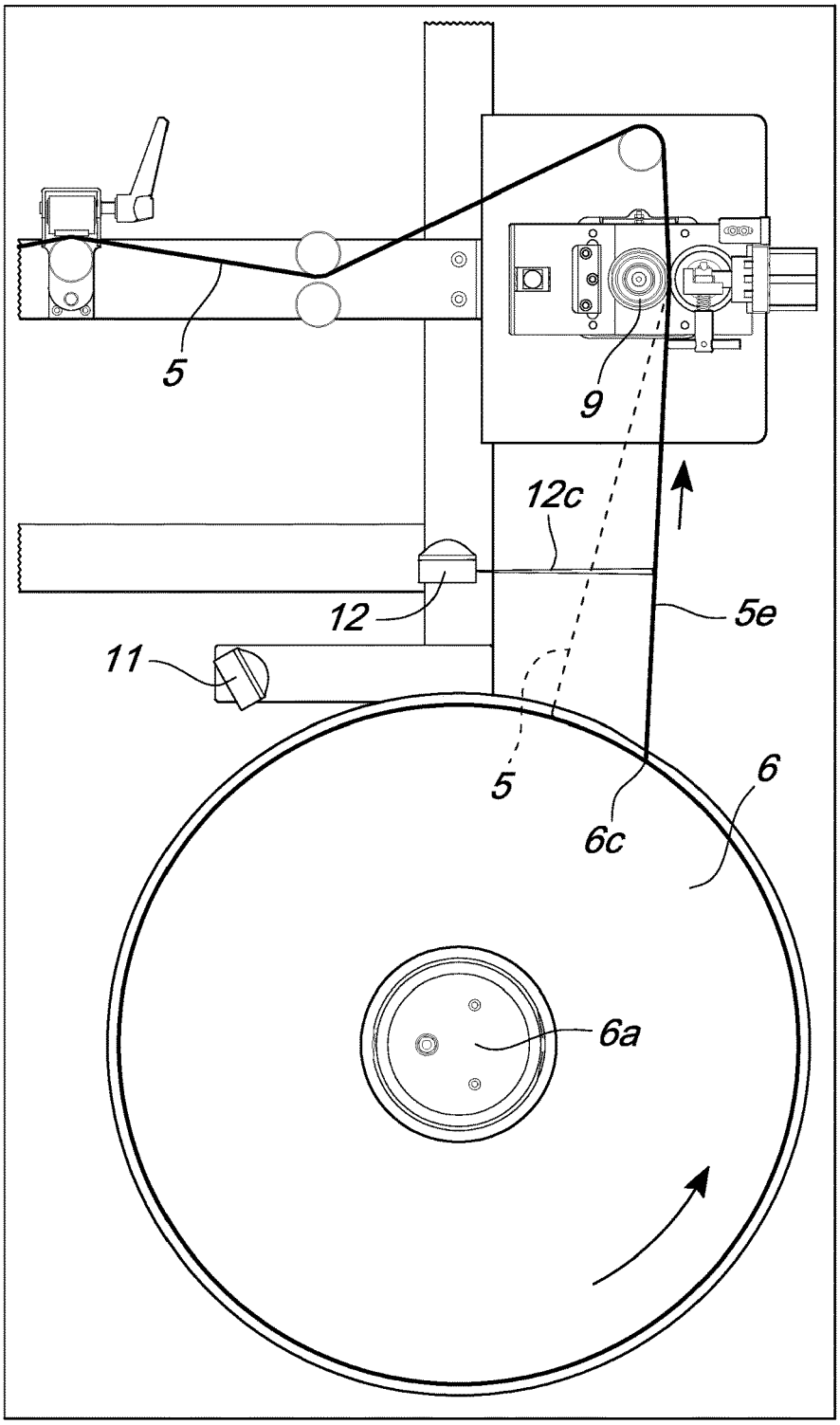

If the roller 9 decelerates or accelerates with respect to the reel 6, the controlled portion of tape moves respectively toward the positions designated by 5*d* in FIG. 3 and by 5*e* in FIG. 4, on opposite sides with respect to the position 5 shown in such figures with a broken line, at the limit of the danger of tearing the tape.

Accordingly, the materialized beam of the photocell 12 assumes the different lengths 12*b*, 12*c* and the compensation device returns the portion of tape toward the position 5.

The described invention is susceptible of numerous modifications and variations, all of which are within the scope of the appended claims; thus, for example, instead of the photocell 12 there can be an ultrasound device.

The disclosures in Italian Patent Application No. VR2013A000193 from which this application claims priority are incorporated herein by reference.

The invention claimed is:

1. A device for applying, around groups of two or more containers, a tape provided on one surface with a layer of adhesive without discontinuities or interruptions in the layer, comprising:

a carousel provided with plates for supporting containers, said plates being shaped so that each one accommodates a group of containers to be wrapped together with the tape;

a drum for cutting and transferring to said groups of containers portions of the tape of a length necessary to wrap each group;

a first motorized roller for unwinding the tape for direct feeding of said drum;

a second motorized roller for preliminary unwinding of the tape from a reel, where the reel is mounted on a third motorized roller, said second motorized roller adapted to feed said first motorized roller with the interposition of a compensation buffer between the second motorized roller and said first motorized roller, said second motorized roller having enough power to produce the continuous separation of the tape from the reel;

a tension control device for controlling a tension of the tape between the reel and the second motorized roller, the tension control device comprising a control unit that maintains a peripheral speed of the second motorized roller the same as a peripheral speed of the reel, wherein the tension control device is provided with means for detecting a position of the tape in a portion comprised between a section of separation from the reel and the second motorized roller.

2. The device according to claim 1, wherein the means for detecting the position of the tape in the portion comprised between the section for separation from the reel and the second motorized roller comprise a photocell.

3. The device according to claim 1, wherein the means for detecting the position of the tape in the portion comprised between the section for separation from the reel and the second motorized roller comprise an ultrasound device.

4. A device for applying, around groups of two or more containers, a tape provided on one surface with a layer of adhesive without discontinuities or interruptions in the layer, comprising:

a carousel provided with plates for supporting containers, said plates being shaped so that each one accommodates a group of containers to be wrapped together with the tape;

a drum for cutting and transferring to said groups of containers portions of the tape of a length necessary to wrap each group;

a first motorized roller for unwinding the tape for direct feeding of said drum;

a reel carrying the tape;

a second motorized roller for preliminary unwinding of the tape from the reel;

where the reel is mounted on a third motorized roller;

a compensation buffer through which the tape extends as the tape is fed from the second motorized roller to the first motorized roller; and means for detecting a position of a portion of the tape that extends between the reel and the second motorized roller.

5. The device according to claim 4 wherein the means for detecting comprises one of a photocell or an ultrasound device.

6. The device according to claim 4 wherein the means for detecting comprises one of a photocell or an ultrasound device positioned to direct a beam onto the portion of the tape that extends between the reel and the second motorized roller.

7. The device according to claim 4, further comprising:

a control unit associated with the means for detecting, wherein the control unit is configured to utilize the position detected by the means for detecting in order to maintain a peripheral speed of the second motorized roller the same as a peripheral speed of the reel.

8. The device according to claim 4, further comprising:

a first photocell positioned to detect a diameter of tape on the reel;

wherein the means for detecting comprises a second photocell positioned to direct a beam onto the portion of the tape that extends between the reel and the second motorized roller.

9. The device according to claim 4, further comprising:

a first photocell positioned to detect a diameter of tape on the reel;

wherein the means for detecting comprises one of a second photocell or an ultrasound device positioned to direct a beam onto the portion of the tape that extends between the reel and the second motorized roller;

a control unit associated with the first photocell and the second photocell, the control unit configured to adjust speed of the third motorized roller based upon diameter detected by the first photocell, the control unit configured to maintain a peripheral speed of the second motorized roller the same as a peripheral speed of the reel based upon the position detected by the means for detecting.

* * * * *